United States Patent [19]

Rody et al.

[11] 4,388,892

[45] Jun. 21, 1983

[54] PROCESS AND APPARATUS FOR GENERATION OF STEAM VIA CATALYTIC COMBUSTION

[76] Inventors: Marc P. N. Rody, 8718 Arlington Blvd., Fairfax, Va. 22031; Frank W. Sudia, 4817 Linnean Ave., Washington, D.C. 20008

[21] Appl. No.: 228,052

[22] Filed: Jan. 26, 1981

[51] Int. Cl.[3] ..... B09B 3/00

[52] U.S. Cl. ..... 122/4 D; 122/28; 122/31 R

[58] Field of Search ..... 122/4 R, 4 D, 31, 28; 431/4, 2; 60/39.55

[56] References Cited

U.S. PATENT DOCUMENTS

| | | | |
|---|---|---|---|
| 2,033,010 | 3/1936 | Russell | 60/39.55 X |
| 2,168,313 | 8/1939 | Bichowsky | 60/39.55 |
| 2,259,010 | 10/1941 | Taylor | 60/39.55 |
| 3,749,318 | 7/1973 | Cottell | 431/2 X |
| 3,860,384 | 1/1975 | Vulliet et al. | 431/4 |
| 4,069,005 | 1/1978 | Palani | 431/4 |
| 4,089,303 | 5/1978 | Brulfert | 122/4 D X |

*Primary Examiner*—Edward G. Favors

[57] ABSTRACT

A mixture of fuel and air is introduced onto a catalytic combustion surface, preferably an inert, refractory substrate coated with trace amounts of a catalyst. Combustion is normally initiated by an ignition device, and proceeds spontaneously once the minimum temperature has been reached. Water is introduced directly onto the heated combustion surface, in metered quantities to prevent cooling below the desired minimum combustion temperature, thus generating a continuous flow of steam at a pressure equal to the inlet pressure of the air, fuel and water. The quantities of air, fuel and water may be varied proportionately to produce rapid variation in the volume, temperature and pressure of the steam generated, a function that may be greatly facilitated by the choice of a combustion element having a low thermal mass. Both the catalytic combustion of fuel and the vaporization of inert working fluids can occur over a wide range of temperature and pressure conditions.

36 Claims, 5 Drawing Figures

87
44a
44b
45a
45b
3
46
P
48
47
69
2
34
44
45
12
35
48a
48b
42
43
41
R
9
37
37
38
36
39
40
54
49
53
51
52
50a
50b
88
50
84a
84b
89
85
84
76
75
77
72
83
78
73
74
80
73
71
79
74a
74b
82
P
86
67a
68a
70a
57
69
66
85
71
67b
70b
68b
57
66
71
67c
70c
68c
57
69
104
59
61
55
14
60
44a
62
58
63
56
57
66
P
64
P
65

PROCESS AND APPARATUS FOR GENERATION OF STEAM VIA CATALYTIC COMBUSTION

OBJECTS OF THE INVENTION

The principal objects of this invention are as follows:

(1) to provide a fuel-efficient method for generating steam using low quality fuel substances, with low pollution emissions, (2) to allow for rapid variation in the pressure, temperature, and volume of the steam produced, with minimal energy waste during such variation, (3) to provide means for supplying, storing, and heating compressed air to be used in the combustion process, (4) to provide means for recovery and purification of water from waste steam, so as to minimize or eliminate water replacement requirements during nonstationary combustion, and (5) to provide means for reclaiming, recovering, and using waste process heat accruing during operation of the described system.

FIELD OF THE INVENTION

This invention relates to a steam or vapor generation process using the catalytic combustion of fuels, including but not limited to (1) liquid or gasseous hydrocarbons or hydrocarbon derivatives such as gasoline or alcohol, (2) hydrogen, (3) carbon monoxide or other partially oxidized hydrocarbon substances, and (4) resins, waxes, fats, or other combustible materials, which may contain water or be emulsions, to provide the heat necessary to vaporize water or other inert fluids. A material such as sulfur vapor could also be used as fuel, though its exhaust is highly polluting unless the resulting $SO_x$ acids are efficiently reclaimed. More particularly, the invention relates to a process whereby feedwater is introduced into a combustion chamber and is vaporized upon contact with the heated catalytic material and by direct and indirect heating, including radiancy and thermal conduction etc., in the chamber.

BACKGROUND OF THE INVENTION

It is known that certain substances denominated catalysts, when present in trace amounts on the surface of a suitable refractory material, can bring about the flameless oxidative combustion of fuels. The relevant group of catalysts includes, but is not limited to, platinum, palladium, silver, zirconium, rhodium, vanadium, iron, nickel, lanthanides, actinides, oxides of the preceding, and carbon black. The combustion process takes place on the surface of the catalyst or catalytic substrate, and appears in part to involve a reaction mechanism whereby the catalyst induces the formation of monoatomic, or "free-radical," oxygen on its surface at low temperatures, e.g., −20°–300° C. In this form, the oxygen readily combusts fuels that come in contact with the surface. Only trace amounts of the catalyst, e.g., 0.05% to 0.2% of platinum by weight on ceramic beads, are required to produce this effect. Another complimentary catalytic process involves the action of materials having high "surface energy," which tend to be hard, high melting point substances as glass, ceramic, polished chromium, etc. The presence of this "surface energy," in the form of uncompensated electric fields associated with the valence electrons of the surface atoms, allows such a surface to capture and hold molecules, such as fuel or water, to await oxygenation or vaporization.

Such molecular capture may also have the effect of lowering the activation energy required to initiate the combustion reaction. The combustion process, thus enhanced by the aforementioned catalytic effects, is virtually 100% complete and leaves no residue, even in the case of fuels that normally require much higher combustion temperatures. Because it is a surface phenomenon, the burn may also be induced to occur in a fixed place, area, or volume, and be given a specific shape, as may be advantageous for the desired result.

The prior art teaches a number of applications for this basic combustion technique. It is used in furnaces and radiant heaters for the combustion of gaseous fuels in industrial and residential settings, in off-gas burners and recombiners to ignite and combust undesired process wastes, in exhaust purifiers to completely combust carbon monoxide and other incompletely burned combustion products that would otherwise be pollutants, and in fluid heaters, boilers and vapor generators to apply the heat of the controlled surface burn to a pipe, tube, or other vessel containing a fluid to be heated or vaporized. (See, e.g., U.S. Pat. No. 3,908,602.)

Another category of catalytic combustion applications may be characterized as ignition devices. Such applications have included the use of catalyst to initiate burning of fuels at extremely low temperatures, to generate atmospheres consisting of $CO_2$, steam, and hot air, or to ignite an explosive mixture of air and natural gas at the bottom of a well to eject water seepage during drilling operations. (See U.S. Pat. No. 3,070,178.)

In regard to inventions that relate to the vaporization of water with the heat of catalytic combustion, it has been generally assumed that the fluid to be vaporized must remain physically removed from the surface on which the combustion is taking place. Typically, this results in process embodiments wherein the water or fluid to be vaporized is contained in boiler tubes or circulation pipes, which are then routed through the site of combustion. Alternatively, the tubes or vessels may be catalytically doped so that their exterior surfaces become sites of combustion. The heat transfer process through the wall of such a tube is generally much better than would have been obtained by placing the untreated boiler tube in an ordinary flame. However, our research has indicated that it is not necessary to physically separate the combustion process from the vaporization process, which can in fact occur in the same surface, even with a large excess of water. If distilled water is used its vaporization does not leave residues that poison or foul the catalytic element. The use of vanadium oxide, in addition to the principal catalyst, facilitates combustion of sulfur impurities in fuels, to prevent formation of those residues. Other fuel-contaminant-specific catalysts may also be employed as needed. As will be more fully set out below, this new conceptual basis for steam generation allows for the creation of new processes and apparatus incorporating a number of substantial machine design and thermal efficiency advantages over previous steam generation processes.

STATEMENT OF THE INVENTION

General

The catalytic combustion steam generation process disclosed herein will generate steam for any application, and need not occur inside a "chamber." It could be embodied most simply as a flat, unenclosed catalytic surface to which fuel, air, and water are directed, resulting in the formation of steam. Air does not have to be the sole source of oxygen, which could be supplied as a component of the water, e.g., as a solution of $H_2O_2$. Oxygen does not have to be the sole oxidizer, since other substances, e.g., chlorine, could perform this function in a suitably chosen reaction. Furthermore, the fuel, water and oxidizer may either be supplied directly to the catalytic element "as is," or any one of the three may be mixed wholly or partially with any other, or all three may be mixed together prior to the combustion/-vaporization reaction in the presence of the catalytic materials.

However, in view of the problems currently being encountered with the low efficiency of gasoline internal combustion engines, and the pollution that they emit, the emphasis of the present discussion will be focussed upon design considerations of a more advanced steam generation and application system that would have potential for use as a prime mover in automobiles, trucks, airplanes, etc.

No limitation to any specific type of steam-driven motor is intended, since all of them may be be used in conjunction with the present invention. However, as will be noted, certain design features or modifications may be required to achieve optimal operation for a given engine type. Furthermore, this disclosure comprehends steam and power generation systems, and other means for steam utilization, both smaller and larger than the typical vehicular application. For instance, the vaporization of water, or some other inert fluid, could be used to operate various single stroke, intermittent linear or rotary actuators, e.g., pistons, impulse turbines, etc., that could in turn be incorporated into robotic devices or prostheses for the handicapped. It will also be clear to those skilled in the art that the process and system could be operated at very low pressures, even below atmospheric pressure, by means of placing an air pump at the exhaust end of the system, instead of at the air inlet, and thereby drawing low pressure air in at the inlet end, which thereupon undergoes vaporization/expansion, as described immediately following, and is subsequently condensed. Such a system would generate particularly low density water vapor, but the vapor would have a very high velocity. Such low density, high velocity water vapor would be useful in ultra-high speed turbines or magnetohydrodynamic devices.

Conventional steam engine systems possess a number of disadvantages for automotive use. In spite of their high fuel efficiency and more complete combustion, they are (1) difficult to start up quickly, and (2) difficult to control so as to allow for rapid speed and power variation without loss of a large heat investment in a relatively high thermal mass device, i.e., the boiler apparatus. Thus, they are unsuitable for short term or intermittent use. The present invention represents a very low thermal mass generator. The refractory catalytic combustion element is a thin, ceramic structure, in the form of a wafer or beads, with a high surface-to-volume ratio.

The present invention will also allow for design of devices with a relatively high energy density. At a nominal operating pressure, one liter of catalytic substrate, 2 mm dia. beads bearing 0.2% platinum, can support combustion of 100,000 liters per hour of a stoichiometric mix of fuel and air. At higher pressures and/or temperatures, this capacity would increase, due to the shorter mean free path of the reactants and higher probability of collision with the surface. Some slowing might be encountered due to the slower ejection rates of combustion products leaving the combustion surface at higher pressures, but this would be overbalanced by the overall faster reaction.

Air Requirements

Using the example fuel methane, a rough calculation can be made of the relation between the air requirements of the process and steam production. Methane has a heat of combustion of 213 kcal/mole. Since $$CH_4+2O_2 \rightarrow CO_2+2H_2O+213 \text{ kcal},$$

two moles of oxygen are required for perfect combustion. Ignoring the volume of the methane, which would be negligible if the fuel were a liquid, we see that two moles of oxygen, or 44.8 liters at standard temperature and pressure (STP), are required to produce 213 kcal of heat +2 moles of steam vapor +1 mole of $CO_2$ waste gas. Since air is approximately 20% oxygen by volume, we will assume a requirement of five times the volume of air, or 224 liters of air to accomplish the reaction. If a precisely controlled amount of water is injected, it can be completely vaporized, assuming conditions of continuous reaction and hot element. The heat of vaporization of water is 254 cal/g. Heat amounting to 213 kcal will vaporize 840 grams of water (=46 moles, at 18 g/mole), provided that the water has been preheated to 100° C., liquid. This in turn yields 1030.4 liters of steam, 100° C. gas. Thus, one mole of methane, combined with 224 liters of air, gives 1030.4 liters of steam, 22.4 liters of $CO_2$, together with an additional 179.2 liters representing the balance of the nitrogen and other unreacted air gases. The total output volume of 1332 liters gives a ratio of about 1 to 5.9 between the volume of the inlet air and that of the resulting products. The number of liters of steam produced per liter of air will vary as a function of the average energy available in the fuel molecule. The presence of the $CO_2$ exhaust and the unreacted air gases will require the use of an engine with slightly larger pistons, or other transducers, if it is to perform as efficiently as would an engine using "pure" steam, since the mixture of steam and gas is not as thermally responsive as pure steam. All gas volumes in the above calculation are referred to (STP), but will remain proportional at true reaction temperatures and pressures. Theoretically, a one liter bed of catalytic substrate can vaporize 460,000 liters of steam per hour; a device of just 10 cc. capacity could produce 4,600 liters per hour. However, the steam will be diluted, in a case such as the example given above, with 14.9% other gases as described.

Air Supply Methods

One means of supplying the air to the combustion chamber would be by use of an air pump with a direct connection to the shaft of the steam-driven motor, since the combustion process air requirements will closely track the speed of the motor. One way of achieving this effect would be to isolate one cylinder of a conventional six cylinder reciprocating engine and use it to pump air, while the other five would constitute the steam motor. Such an arrangement would result in an air-to-steam ratio of 1:5. Other supply systems are also possible.

Once the engine and pump have commenced operation, the process of pumping the air should not consume any net energy. Except for the frictional losses in the pump and engine and the friction of the gasses in their respective channels, the thermal energy of pressurizing the air to be injected into the combustion chamber will be recovered when the partial pressure of the air in the resulting steam mixture is fed into the engine. The work so recovered in turn drives the pump, etc. A similar effect is obtained in an ordinary gasoline engine where the work of pressurizing the air in the compression stroke is recovered by the reexpansion of the same air on the power stroke.

Control Systems

Precise control over the device may be attained by variation in the amount of air, fuel, and water that enter the chamber and strike the element. Throughout this disclosure it is to be assumed that the processes and devices disclosed will be controlled by servo-loop control systems where necessary to create the described effects. All of the reaction equations, steam yields, pressure-temperature relationships, etc. can be reduced to mathematical models. Input into the servo-loop device(s), i.e., loop-modifiers, can come from operator commands, such as: "speed-up", "slow-down", etc., as well as electrically operated thermometers, pressure gauges, flow meters, strain gauges, gas analysers, tachometers, barometers, accelerometers, etc., and output from the control system can operate the numerous possible valves, fuel and water injectors, ratios of valve settings, pumps, auxiliary motors, clutches, heat exchangers, spark plugs, heating elements, and air dampers, etc. that may be a part of various embodiments of the disclosed system. The designed-in balancing of the servo-loops will result in the automatic adjustment of process parameters, making it possible to maximize combustion efficiency and steam yields, minimize undesirable by-products or safety hazards, and efficiently control all subsidiary systems such as heat transfer, heat reclaimation, water recovery, air pumping, and compressed air storage systems.

Utilization of Lower Quality Fuels

Because the catalytic combustion reaction lowers the activation energy required to initiate combustion, fuels that normally require high temperatures for burning can be combusted at lower temperatures that are more convenient from a process design standpoint. For example, ordinary flame combustion of wood occurs at about 600° C., while many of the substances present in the wood smoke do not ignite until a temperature of at least 1,200° C. is reached. This results in considerable waste of fuel energy in the smoke. If however, the wood smoke is passed over a heated platinum catalytic element, the distilled wood tars, creosote, or other high temperature components will combust at 600° C., or below. As a result of this modification to the combustion reaction, low grade fuels, such as heavy residual oil, water-alcohol mixtures, solvated or emulsified pitches or tars, etc. can also be used in the steam generation process. Even high melting point materials such as paraffins or waxes could be handled and introduced into the combustion chamber by means of pressure or heated fuel lines. Control system adjustments for fuel heat content will allow rapid substitution of fuels without modification of the combustion device. Such substitution of fuel can in fact occur instantaneously during device operation while steam is continuously being produced. One embodiment incorporates a dual fuel handling and injection system, with a high grade fuel, e.g., propane, being used to initiate combustion and bring the element up to a temperature high enough to initiate combustion of heavier fuel, whereupon a low-grade fuel, e.g., No. 2 oil, can be substituted in a continuing reaction. Addition of ultrasonic energy in the fuel-air mixing area may enhance the efficiency of fuel mixing and combustion for a given chamber design. Fuel and water can also be mixed in a number of ways prior to combustion, including (1) passing the fuel through micro-pores under high pressure into a volume of water, which tends to create a suspension of very small droplets, or (2) placing fuel and water together in a mixing area and introducing ultrasonic energy to facilitate mixing sufficiently to create such a suspension. Mixing and suspension might also be facilitated by the addition of surfactant materials.

Catalytic Cracking and Zone Combustion

The efficient combustion of the large, heavy fuel molecules that are characteristic of low quality fuels may be enhanced by the addition of a catalytic hydrogenation or "cracking" step at the front end of the combustion chamber, to facilitate the oxidative combustion of fuel at later points in the catalytic combustion process. Although catalytic oxidation is effective in combusting low quality fuels at low temperatures, if hydrogen could be added, thus breaking long unsaturated hydrocarbon chains or ring structures into smaller molecules, the efficiency of their combustion could be improved. To effectuate this cracking, the following is a typical catalytic hydrogenation reaction that may be utilized:

$$C_nH_n + H_2O \xrightarrow[1200^\circ\ F.]{Fe_2O_3} C_nH_{n+2} + O.$$

The chamber is accordingly modified to include a large surface area of hot iron, naturally coated with its own oxide, at about 1200° F., at the end where incoming fuel and water are entering and approaching the catalytic combustion element. Only a small amount of air, if any, is used initially to serve as a vehicle to move the fuel. A comparatively small amount of water is used at this stage, to prevent excess cooling of the hot iron oxide catalyst. The water could be supplied as a component of the fuel if the fuel were an emulsified oil or tar. The heating of the iron oxide catalyst can be achieved by supporting the iron oxide on serrated iron rods or bars, the lower ends of which are extended into the catalytic combustion element, e.g., into the volume of packed ceramic beads. Then, the main supply of air for combustion may be introduced through the sides of the chamber into the upper zone of the element, so that combustion occurring there can heat the rods or bars and the heat can be conducted up to the site of the hydrogenation reaction. Such bars may be hollow and filled with metallic sodium or potassium and appropriate wicking material to act as heat pipes. The main supply of feedwater for steam production may be introduced further down in the combustion column, where its vaporization will be assisted in part by the heat flowing from the higher zone of combustion. Additional quantities of air may be added at points further down along the catalytic combustion column, to make up the full stoichiometric volume needed for combustion. Although the "cracking" step may occur at a higher temperature than will generally be used for the catalytic oxidation step, heat loss from the "cracking" step should be minimal, if the chamber is well insulated. The heat of the initial burning that is used to heat the cracking catalyst, even though it occurs in the absence of water, will still flow toward the steam generation step, and be completely utilized. Although the hydrogenation process consumes both energy and water, these are recovered during the immediately ensuing burning of the product. In addition to iron/iron oxide, other metal/oxide combinations such as copper/copper oxide or cobalt/cobalt oxide may be employed as catalysts in the catalytic hydrogenation step, and other means of heating the cracking catalyst may be used.

Catalytic Element Vaporization

Unlike conventional steam generation devices, there is no wall, such as of a tube or flask, etc., separating the area of steam vapor generation from a lower pressure area of combustion. Hence there is the possibility of the use of much less metal in the steam generator, and there is much less possibility for the catastrophic wall failures that cause safety and reliability problems in conventional steam systems. The combustion chamber can be compact, and the surface area requirements of the normal vaporization heat exchanger are greatly reduced, or conceptually eliminated. If fouling or erosion of the element does occur in service, for whatever reason, the chamber may be opened and the element easily and inexpensively removed, without a need for difficult or expensive boiler-scale removal operations.

Explosion Avoidance

The natural tendency of most common fuels to explode when placed in a chamber with heated compressed air can be controlled and eliminated by the following means:

(1) Delayed injection of most of the required air. Only enough air needs to be injected at the beginning of the process to act as a carrier for the incoming fuel. The remainder can be injected through ports in the sides of the combustion chamber that make the air available to the sides of the catalytic substrate column, thus creating a "zone combustion" process within the catalytic substrate.

(2) Injection of the fuel after injection of the water. Water will tend to scavenge free radicals that may be present and that could trigger explosion. Also, the air pressure and temperature will drop substantially once water droplets are present.

(3) Limitation of the free air volume in the combustion chamber. Fuel and air need be mixed together only a short time before entering the catalytic element, e.g., a column of tightly compressed beads. Alternatively, fuel may be injected through tubes lying directly in the catalytic mass.

(4) Use of "low grade" fuels, including emulsions or solutions, that do not explode at the temperatures and pressures encountered in the chamber, and do not otherwise burn without the aid of a catalyst at the chosen temperature.

These techniques, combined with a careful attention to process engineering, can virtually eliminate the hazards of explosion, and any resulting problems of reliability. The utilization of surface combustion and surface vaporization, in lieu of catalytic ignition (or detonation) and explosion, forms a significant distinction between the present invention and the prior art as disclosed in U.S. Pat. No. 3,070,178.

Consequences of Variable Pressure

Because of its potential for very high pressures, the disclosed steam generator is particularly suited for operating high compression type engines that yield higher overall thermal efficiency. Also, because the degree of control over the temperature, pressure and volume of the steam is virtually total, there is no limitation on how slow the driven engine can operate, e.g., piston type engine. Thus, as long as a supply of compressed air is available to restart combustion, or to assist it at very low speeds, it will be possible to run the engine without a requirement for "idling" it prior to rapid restart at high power. Since the steam is generated at high pressure, and the quantity delivered can be widely varied, the engine can be operated efficiently at any speed/power ratio that may be required, thus eliminating the need for a "transmission" or gear reduction system. In a piston-type engine this effect will be especially aided by the use of cylinder head valves, such as electrically actuated valves, that may be opened for variable amounts of time, to permit injection of smaller amounts of steam at high speed/low power, or of larger amounts of steam at low speed/high power.

Air Storage Technique

Since engine deceleration under load will normally generate an unneeded supply of air at the air pump, if it is directly coupled to the main power shaft, during the process of "engine braking" when air is not needed to support combustion, a portion of the energy loss of engine braking can be recaptured by using the air pump to pressurize an air flask. This air flask can then be opened to supply a quantity of compressed air to restart the combustion/vaporization process without resorting to a conventional auxiliary starting motor.

Air Acceleration Effect

In order to accelerate a steam-driven motor that is coupled to its air pump, it will be necessary to arrange the delivery of an excess of air over that required for its normal operation at a given speed, assuming that the ratio of air/fuel/water and resulting steam is held constant. To do this an air pump must be specified that has a capacity in excess of that required to support a steady state combustion process. The output of this pump is then controlled by a pressure regulator. If for example, the air was being pumped by an isolated cylinder of a piston type engine, it would be possible to operate the piston valves so as to draw out only that volume of air on the compression/"exhaust" stroke that was required to achieve the desired pressure at a given throughput volume. The excess air remaining in the cylinder after the exhaust valve had closed would not result in a significant waste of energy, since the thermal energy of compressing it would be recovered by allowing it to reexpand under pressure, with the pump piston still coupled to the shaft, before admitting additional air on the next intake stroke. Various other types of pressure regulation are also possible.

During a period when rapid acceleration is desired, the regulation mechanism may be adjusted so that excess pump capacity relative to steady state needs is channeled directly through the combustion/vaporization and engine systems. In effect, it will supercharge the combustion process and result in a "boot-strapping" effect. Once the desired seed is attained, the air capacity will again be in excess of requirements, and must be re-regulated to a lower volume per unit of radial motion.

Pulse-Mode Operation Concept

A high-pressure catalytic steam generator may also be operated in pulse mode to reduce or eliminate the need for an independently powered air pump to supply high pressure air to the reaction chamber. Under this design, the air inlet(s) of the chamber is (are) fitted with one-way air valves that may be reed valves, or other spring loaded valves that will admit in-flowing air, but will close to prevent the escape of pressurized, exploding, or expanding gasses in the chamber. A similar outflow valve may be used at the steam outlet port, but is not necessary to create the effect.

When the chamber is operating normally, air will be pumped in by an external air pump, fuel and water will be injected, and steam will be continuously generated. Once the element is hot and a pre-determined rate of air/steam flow-through has been reached, the pulsed operating mode may be achieved as follows: (1) fuel and water injection are momentarily stopped; (2) air is injected to fill the hot chamber; (3) air pumping is stopped or at least is greatly reduced; (4) fuel and water are injected in small, measured amounts corresponding to the amount of air present; (5) the expanding force of the resulting combustion/vaporization forces the resulting steam out the steam exit port, since the air inlet is now blocked by the one-way reed valve; (6) the momentum of the exiting steam and gas from the explosion causes a partial vacuum to be created in the air inlet end of the chamber; (7) this partial vacuum opens the one-way inlet valve and draws in a quantity of air. Then the above process repeats, beginning with the step numbered (4), this time without the aid of the air pump, or with only partial assistance.

The pulse effect thus depends on carefully timed injection of fuel and water, to coincide with the harmonic characteristic of the induced partial vacuum air intake phenomenon. The pulse rate could be set at several hundred or thousand per minute, depending on chamber design, and in a normal transportation application, could be set to correspond to the approximate steam production rate necessary to maintain an optimal "cruising speed", e.g., 55 mph. Roughly the same amount of energy will be consumed by the pulsed operation air pumping method as would be with the use of an external air pump, since the internal momentum of the flowing steam is used to create the partial vacuum. Its use may lead to machine design advantages, but with a corresponding risk of metal fatigue from the vibration.

The pulse-jet concept is long known in the area of rocket engine design, and was used in the "V-1" type rockets developed by the Gemrans during World War II. Such rockets relied on the pulsed burning of fuel only to propel them, and steam was not produced. Nevertheless, the method can also be used to operate the pressurized type of catalytic combustion chamber disclosed in this invention.

Pollution-Reduction Effect

The condensation and recycling of waste steam will result in a relatively small supply of water being needed to support operation of the steam system for long periods of time. Also, since the combustion of fuels containing hydrogen releases water as a waste product, water will always be available in excess when such fuels are being utilized. The principal reason why the steam system disclosed herein will have very low pollution emissions is that the $NO_x$ and $SO_x$ exhaust products of combustion will normally go into solution in the condensed water as their respective acids, and not be released into the atmosphere. Depending on reaction conditions, high pressure combustion in the presence of a catalyst may result in production of $NO_x$ from atmospheric nitrogen. The conventional way to avoid this effect, in non-catalytic applications, is to make the air/fuel mixture more rich in fuel, so that the excess fuel will scavenge the available oxygen and prevent or limit the formation of $NO_x$. However, such rich fuel mixtures result in incomplete fuel combustion and production of excess carbon monoxide (CO), which must be eliminated in a catalytic after-burner. The present invention provides a means for safe removal of $NO_x$ and $SO_x$ acids ($SO_x$ resulting from the sulfur impurities commonly found in fuels) from solution in the condensate, so as to avoid the necessity of incomplete fuel combustion as described above, and to allow reuse of the water without eventual damage to the equipment from acid buildup. The waste water and exhaust gas processing component of the system (1) condenses the waste steam, see FIG. 5 and accompanying explanations, (2) removes the $CO_2$ gas and the non-oxygen components of the air used for combustion from the water via centrifugal separation at atmospheric pressure, and (3) titrates and distills, or otherwise extracts, the $NO_x$ and $SO_x$ acid salts from the water, yielding distilled water for reuse in the steam system, and a brine, containing nitrates, nitrites, sulfates, sulfites, etc., that should have appreciable economic value as an agricultural fertilizer. It should be noted that removal of the $CO_2$ will not always be necessary, since if the water condensate is cool enough, it will stay in solution as $H_2CO_3$, and be capable of being titrated, e.g., to $(NH_4)_2CO_3$. Numerous means are known to the arts for purifying water of dissolved acid or salt impurities, including ion-exchange resins, high-pressure osmotic dialysis, etc.

Waste Steam Condensation

Condensation of waste steam following its utilization in a closed system application, e.g., an engine or turbine, may be accomplished in a three step process as follows: (1) the waste steam from the application, which may have been diverted for other purposes and returned, is fed to a first-stage heat exchanger with a high boiling point secondary cooling fluid. The secondary fluid is cooled by circulation through an external radiator equipped with a fan. The first stage will normally lower the temperature to just above the point of condensation, at its operating pressure, to avoid pitting of the heat exchanger from high velocity water droplets. (2) The cooled steam and exhaust gas mixture is then sent to an expansion chamber, configured in a manner similar to that in a conventional refrigeration system. The expansion drops the temperature below 100° C., and causes virtually all of the water to condense, while the $CO_2$ and waste air remain a gas and the $NO_x$—$SO_x$ acid wastes are in solution. (3) The $CO_2$ gas, the waste air, and the remaining water vapor are then sent into an adiabatic reflux condenser. This condenser has a venturi jet at the top which directs the flow of exhaust gas and water vapor, which is now cooler as a result of expansion following the venturi, over the outside of the condenser coil, to assist in refluxing the water back down into the expansion chamber. The diameter of the venturi may be controlled by a regulation valve, and automatically adjusted to optimize the pressure in the expansion chamber and the exhaust separator.

Exhaust Gas Separation

The throughput gases that emerge from the cooling sleeve of the adiabatic reflux condenser are sent radially into a centrifugal separator. The separator can capture water droplets down to as small as 10 microns in diameter. The exhaust gas will exit through the top of the separator to the atmosphere, and most of the liquid water will fall to the bottom. Both the expansion chamber and the centrifugal separator are fitted with water pumps to remove the water and return it to a water storage tank. Various configurations of known devices will condense water and separate exhaust gases in a manner similar to those described, which are intended only as representative process embodiments. It is not necessary that the exhaust gases be removed at atmospheric pressure, though this will result in convenient operation.

Heat Reclaimation Steps

Heat reclaimation and reuse is an important part of any thermodynamically advanced engine system. The disclosed processes contemplated a number of heat transfers from parts of the system having excess heat, to those requiring heat. The two principal sources of heat are the waste steam, and any carbon monoxide that may be present in the exhaust gasses after separation. This CO fuel energy can be reclaimed by passing it through a catalytic afterburner that is also a heat exchanger. The four principal uses of this energy are (1) heating the engine block and the area around the primary steam lines between the generator and the engine so as to reduce loss of primary heat energy, (2) heating the incoming air prior to combustion, either before or after compression, (3) warming the fuel (or fuels) and the boiler feedwater prior to injection into the combustion chamber, (4) operating the boiler of a still, of used, to remove the acid salts from the water to be recycled in the steam system. Waste steam exiting from the engine, or other closed application, is suitable for all of these uses. CO waste, if present, will find principal use for air pre-heating in a catalytic heat exchanger, due to the low volumes expected, its low concentration in the carrier gases, and the consequent low temperature of the resulting combustion.

INDEX OF NUMBERED ELEMENTS OF THE DRAWINGS

1. air inlet
**1*a*.** auxiliary air inlet
2. water line
**2*a*.** auxiliary water line
3. fuel line
**3*a*.** auxiliary fuel line
4. water venturi
5. fuel venturi
6. combustion chamber
**7*a*.** catalytic element (honeycomb)
**7*b*.** catalytic element (beads)
8. spark gap igniter
9. steam outlet
11. water injector (solenoid)
**11*a*.** auxiliary water injector (solenoid)
12. fuel injector (solenoid)
**12*a*.** auxiliary fuel injector (solenoid)
14. condenser enclosure (adiabatic reflux condenser 59)
15. ultrasonic transducer
16. mixing area
17. screen (to retain catalytic beads)
18. ring (to retain screen)
19. spring (to compress beads)
20. combustion chamber wall
21. threaded ring (to support 22)
22. concentric pipe
23. air channel
24. concentric sleeve
**24*a*.** sleeve hole
25. air inlet hole
26. pinion (to drive gear **26*a***)
**26*a*. gear (to turn 24**)
27. shaft (to adjust hole aperture **24*a*, 25**)
28. cylinder wall (vacuum flask)
29. end cover (vacuum flask)
30. fastener (for end cover)
31. air outlet (to evacuate flask)
32. mirrored interior surface
33. spark gap
34. air line
35. steam generator
36. steam driven motor
37. motor power shaft
38. air pump
39. air filter
40. air intake
41. air pressure regulator
42. air flask
43. drain cock
44. air heater (catalytic combustion heat exchanger)
**44*a*.** exhaust line
**44*b*.** spent exhaust line
45. air heater (steam heat exchanger)
**45*a*,45*b*.** air heater steam lines
46. fuel pump (high pressure)
47. water pump (high pressure)
48. water warmer (steam heat exchanger)
**48*a*,48*b*.** water warmer steam lines
49. motor outlet (waste steam)
50. first stage condenser
**50*a*,50*b*.** secondary coolant lines
51. external radiator
52. fan
53,54. motor heating steam lines
55. steam line (to adiabatic expansion condenser 56)
56. adiabatic expansion condenser
57. liquid water
58. anti-splash fins
59. adiabatic reflux condenser
60. reflux condenser coil
61. exhaust gas venturi
62. vapor line (to separator)
63. centrifugal separator
64,65. water pumps (low pressure)
66. condenser outlet line
**67*a*,67*b*,67*c*.** water storage tanks
**68*a*,68*b*,68*c*.** water recirculation uptake lines
69. water recirulation line
**70*a*,70*b*,70*c*.** still uptake lines
71. still feed line
72. steam distillation unit
73. brine solution
74. steam heating element
**74*a*,74*b*.** heating element steam lines 75. filler funnel (titrant tank)
76. titrant supply tank
77. titrant solution
78. titrant line (to still)
79. brine drain line
80. brine holding tank
81. brine
82. brine drain port
83. still outlet line
84. water jacket condenser
84a,84b. water coolant lines
85. condenser outlet line
86. still water pump (low pressure)
87. air supply subsystem
88. water condensing and exhaust separation subsystem
89. steam distillation water purification subsystem
90. spring air intake valve assembly
91. valve
92. valve stem
93. valve spring
94. valve housing
95. air cavity (shock absorbing)
96. latch (to hold valve open)
97. needle valve (shock damping adjustment)
98. valve seat (beveled)
99. serrated iron bars
100. perforated plate (to support 99)
101. lower extension (of iron bars 99)
102. auxiliary air manifold
103. reatining screen
104. regulation valve (venturi size adjustment)
105. air valves (butterfly)

DETAILED DESCRIPTION

Figure 1:
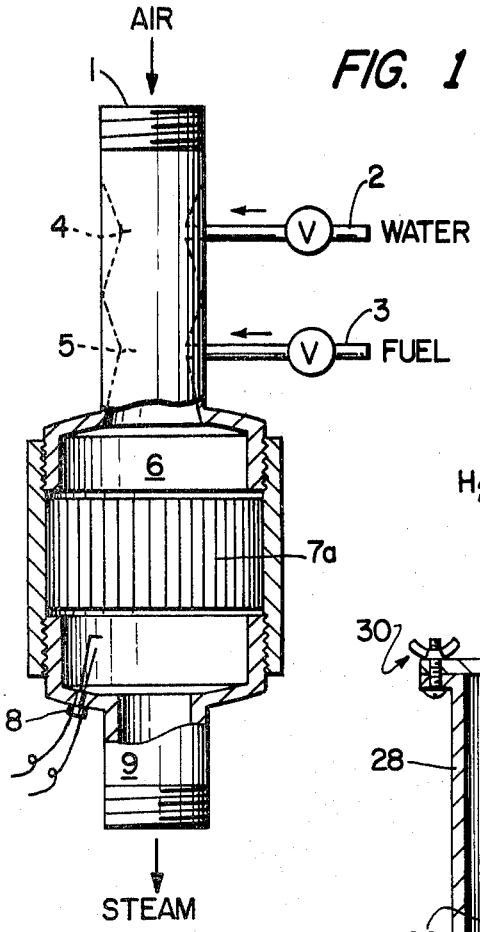
FIG. 1 is a cross-sectional view of an illustrative embodiment of the present invention, enclosed in a combustion chamber.

Turning now to FIG. 1, the basic catalytic combustion steam generation process is to be understood to be initiated when compressed air is introduced via air inlet 1, and passes through water venturi 4 and fuel venturi 5. When the fuel valve is opened, fuel venturi 5 draws fuel through fuel line 3, and aspirates it into combustion chamber 6. On passing through catalytic element 7a, the air/fuel mixture is ignited by spark gap igniter 8, and initially burns as a flame on the lower side of the element 7a. Shortly, the element 7a heats to 120°-300° C. and combustion proceeds flamelessly on the element surface. Then the valve to water line 2, is opened allowing water venturi 4 to draw water. The atomized water strikes heated catalytic element 7a and is vaporized. Steam is emitted through steam outlet 9, along with combustion waste gases and unreacted air components.

Figure 2:
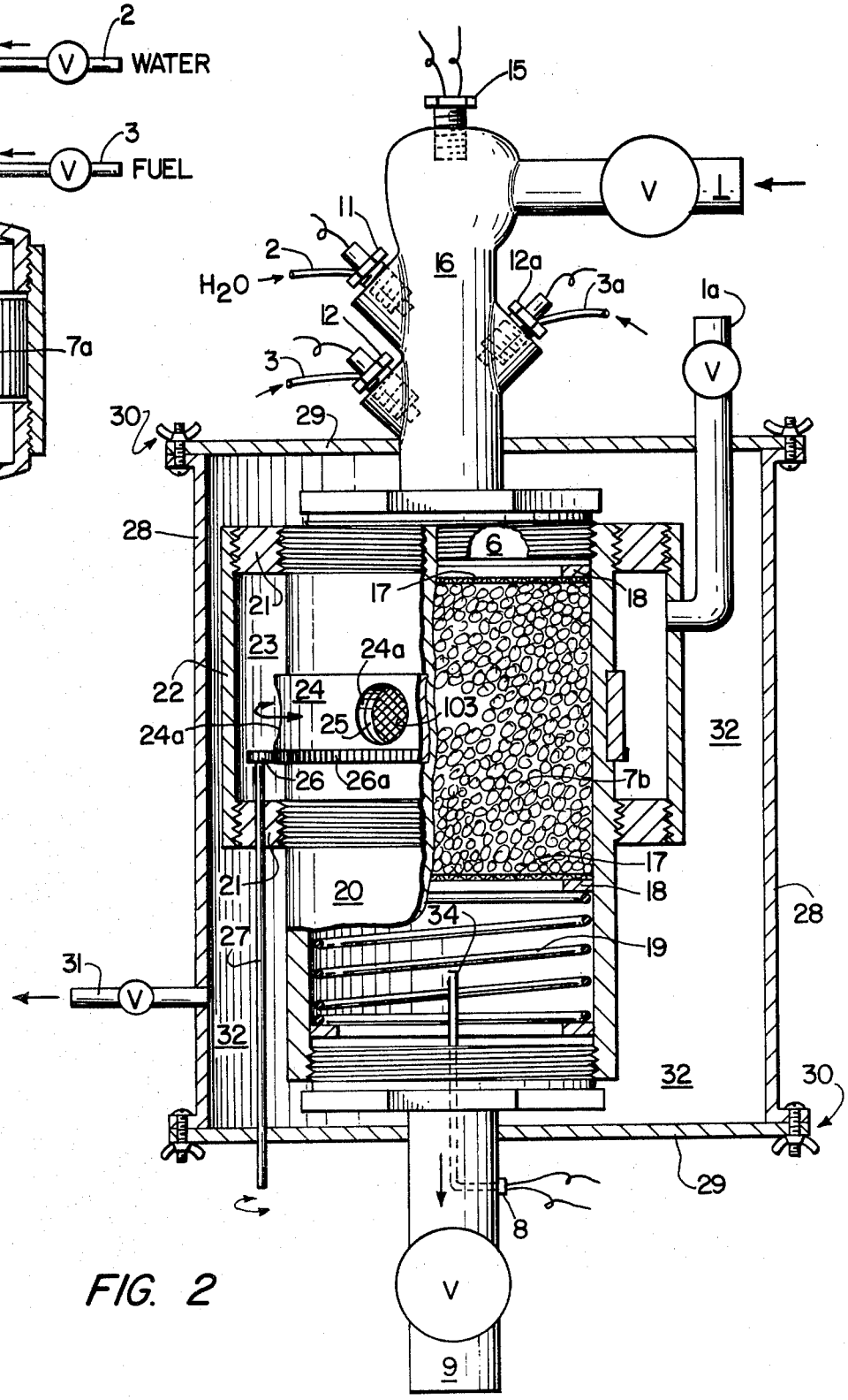
FIG. 2 is a cross-sectional and partial cut-away view of a catalytic combustion steam generator embodiment illustrating detailed process design alternatives, including zone combustion and vacuum flask insulation.

FIG. 2 shows a catalytic combustion chamber embodiment including a number of alternative design considerations. A heavy steel combustion chamber wall 20 encloses the combustion chamber 6 containing the catalytic element 7b, consisting of ceramic beads. The ceramic beads are coated with trace amounts of catalyst and are compressed between metal screens 17 held by retaining rings 18. A spring 19 compresses the beads to prevent erosion and chipping of the beads through agitation. Compressed air is introduced through air inlet 1, and may be energized by an ultrasonic transducer 15 to assist in the mixing of fuel and air in mixing area 16. A high grade fuel, such as propane, is introduced via fuel line 3 through fuel injector 12, mixed with air, passed through catalytic element 7b, and is ignited by spark gap 34, supported from below, to initiate combustion. Once the burn has heated catalytic element 7b to the required temperature, combustion of lower grade fuel may commence. A fuel such as No. 2 oil may be introduced through auxiliary fuel line 3a, be injected via auxiliary fuel injector 12a, and mix with ultrasonically energized air in mixing area 16. Thence it is passed into combustion chamber 6 and is combusted by hot catalytic element 7b. The steam generation process may be initiated by opening water injector 11 to admit water from water line 2. The water is injected in measured amounts corresponding to the heat that is available without cooling the element below the temperature at which it will support combustion of the fuel in use. It is also possible to suspend or homogenize any of the three reactants with any or both of the others, wholly or partially, by use of ultrasonic mixing or equivalent means, prior to injection in the combustion chamber.

In order to reduce the risk of explosion of fuel and air under high pressure, only enough air need be introduced via air inlet 1 as is necessary to act as a carrier for the water and fuel(s). The remaining air needed for complete combustion may be introduced via auxiliary air inlet 1a into air channel 23 formed by concentric pipe 22 and threaded rings 21. One or more moveable inset concentric sleeves 24 with holes 24a, may be adjusted via gears 26, 26a, and shaft 27 so that the holes in the sleeve cover or uncover air inlet holes 25 in combustion chamber wall 20, admitting variable quantities of air into catalytic element 7b. Additional similar concentric sleeves could be used to control admission of air through additional air inlet holes at higher or lower levels during the combustion process, thus creating zones of progressively more complete combustion. In order to reduce heat loss through the combustion chamber exterior, the chamber may be insulated by enclosing it in a mirrored vacuum flask, such as a Dewar flask, with cylinder wall 28, and end covers 29 secured by fasteners 30. The air may be evacuated via air outlet 31. The mirrored interior surface 32 reflects radiant energy back to the combustion chamber.

The combustion chamber air inlets 1, 1a, and steam outlet 9 are shown furnished with valves to permit an intermittent steam generation process. Under this process the element 7b is brought up to the temperature necessary to support flameless combustion as before, but then the fuel and water injection are stopped and the steam outlet 9 valve is closed, causing the chamber to become pressurized with hot air. Then air inlet 1, 1a valves are also closed. Fuel and water are injected in an amount proportional to available oxygen in combustion chamber 6 and the catalytic element 7*b* interstice volume. The fuel combusts and steam is produced. The steam outlet 9 valve is opened to release the steam, then is closed, and the process repeats as before, with compressed air being pumped in, etc. As will be clear to those skilled in the art, the basic process described requires only the use of a chamber with valves on the intake and outlet, with positive acting valves on the fuel and water intakes, to achieve intermittent steam generation.

Figure 3:
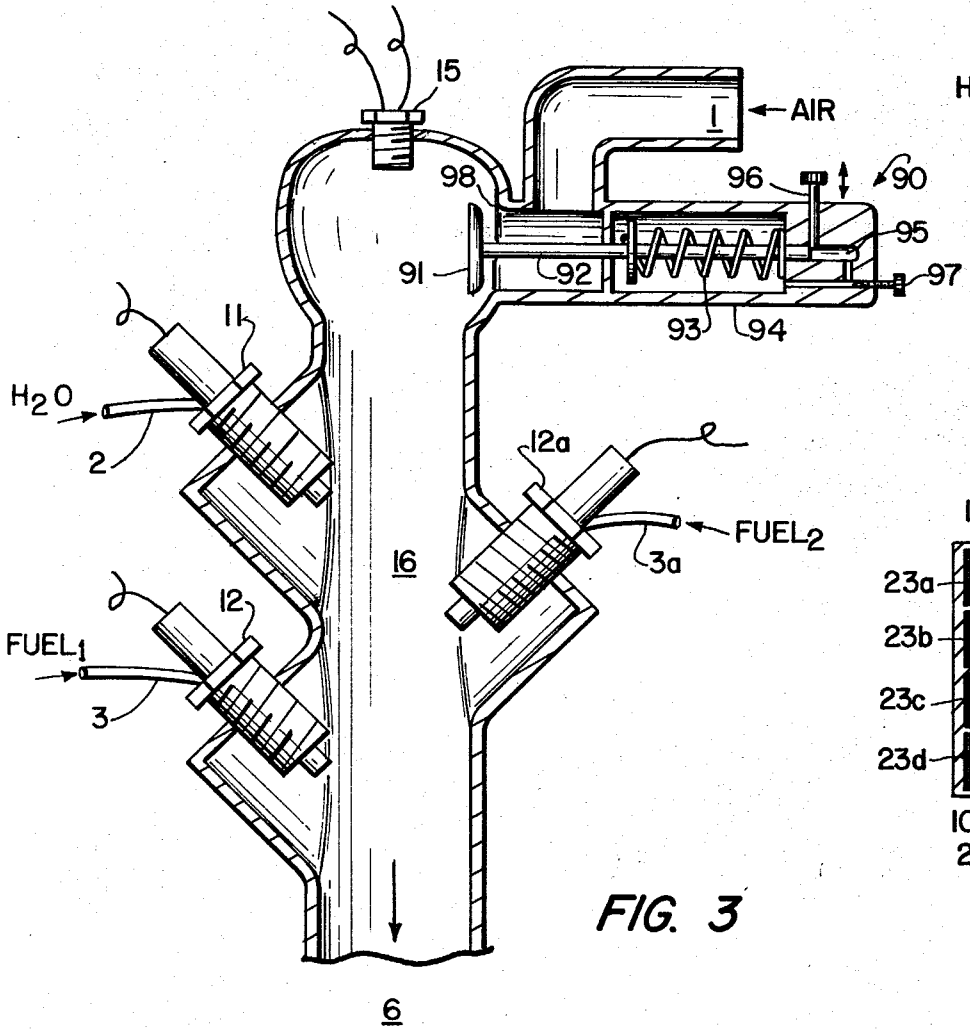
FIG. 3 is a cross-sectional view of a spring air intake valve to be used in conjunction with apparatus such as that in FIG. 2 to achieve pulse-mode combustion effects.

FIG. 3 shows a cross-sectional view of a valve assembly suitable for use as an adjunct to the apparatus shown in FIG. 2 to achieve the pulse-mode combustion effect previously described. The drawing represents a modified version of the upper part of FIG. 2, wherein air, fuel, and water are mixed in mixing area 16 and pass to combustion chamber 6.

A spring air intake valve assembly 90 allows a pulse-mode of operation of the combustion chamber 6 wherein a partial vacuum induced in the chamber 6 is used to suck in additional fresh air for a repetition of the explosive process. A valve 91, shown in an open position, is supported on valve stem 92 and regulated by valve spring 93. A valve housing 94 contains and supports the valve 91 and spring 93. An air cavity 95 is provided at the base of valve stem 92, which acts as a piston, to function as a shock absorber preventing excess wear as valve 91 slaps into beveled valve seat 98. A needle valve 97 can be used to regulate the damping effect provided by air cavity 95. A latch 96, which is optional, holds the valve 91 open during normal operation. When the latch 96 is is released, valve spring 93 holds the valve 91 in a closed position with a low tension, allowing it to serve as a one-way valve, through which air is readily admitted, but which prevents the escape of gas in the opposite direction when internal pressure exceeds external pressure. The alternation of pressure and partial vacuum is created by carefully timing the injection of fuel and water. Even if the partial vacuum thus created does not dip below normal air pressure, the pulse mode of operation may allow a much lower pressure of air to be supplied to the chamber, which will still reduce energy requirements at the air pump, the principal objective of this feature. As will be clear to those skilled in the art, there are many ways of providing and configuring a one-way air valve. If two or more air inlet ports are in use, similar air valves must be provided for all of them, with their spring tensions appropriately adjusted for synchronous operation, or alternatively, all of the air inlets may be supplied through the same spring air intake valve via an air manifold. The fuel and/or water ports may also be equipped with spring, or "reed" type valves. In a suitably designed combustion chamber 6, the resonant properties of the chamber 6 may be realized in such a way that "constant pressure nodes" would coincide with the reactant ports, eliminating the need for valves at all during pulse-mode combustion, assuming reactant supply lines pressurized to the mean pressure of the chamber. The movement of pressure waves would be sufficient to alternately draw reactants and expel water vapor.

Figure 4:
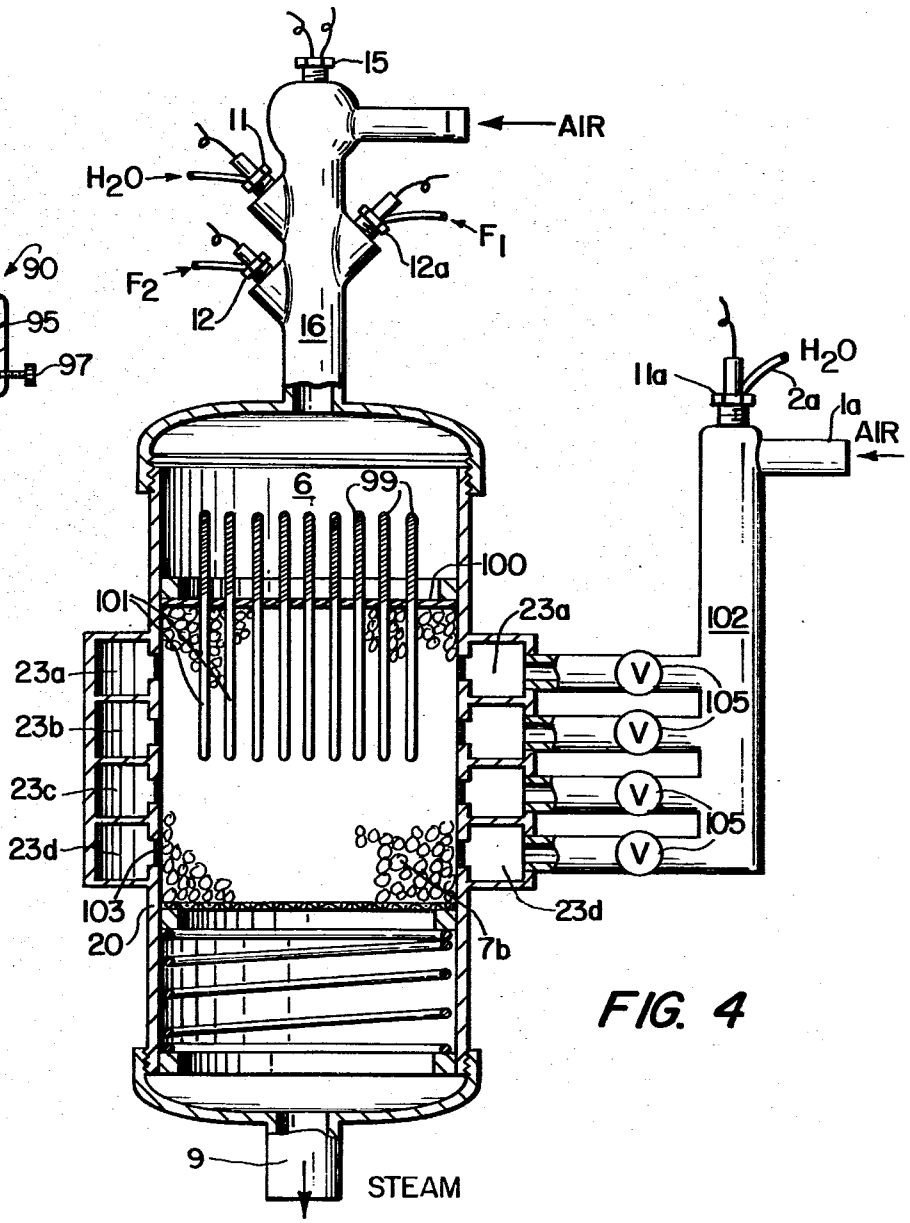
FIG. 4 is a cross-sectional and cut-away view of a catalytic combustion steam generator embodiment illustrating means for catalytic hydrogenation of fuels, and also showing an alternate form of zone combustion system.

FIG. 4 shows a combustion chamber 6 embodiment similar to that in FIG. 2, except that means are provided for an additional step of catalytic hydrogenation for heavy fuels containing large, partially unsaturated hydrocarbon chains or ring structures. Combustion can be initiated and sustained as before using any grade of fuel. But where a low grade fuel is being used that is amenable to catalytic hydrogenation, e.g., crude oil, tar, pitch, waste oil, etc., the special features of this process can come into play. Serrated iron bars 99, which are supported by perforated plate 100, extend some distance into the matrix of the catalytic element 7*b*, to lower extension 101. The injection of the main water supply from above via water injector 11 may need to be reduced because it can prevent the serrated iron bars 99, coated with hydrogenation catalyst $Fe_2O_3$, from heating to a temperature sufficiently high to support efficient hydrogenation. Therefore means are provided for injecting additional water at lower zones in the combustion column or catalytic element 7*b*, via auxiliary water injector 11*a* which draws high-pressure water from auxiliary water line 2*a*. In this arrangement serrated iron bars 99 can become much hotter, due to the conductive flow of heat through them from catalytic element 7*b* below. At a temperature of approximately 760°–870° C., serrated iron bars 99, naturally coated with the catalyst $Fe_2O_3$, become sites for a catalytic hydrogenation reaction when unsaturated heavy fuels are vaporized and passed thereover in the presence of a small amount of water vapor. Water necessary for the hydrogenation reaction may be injected in small amounts through water injector 11, or supplied as a component of the fuel. Iron oxide, which forms naturally on the surfaces of the bars, catalyses the transfer of hydrogen from the water to the unsaturated bonds of the fuel, causing it to split into smaller, more readily combustible fragments. The reaction is well known to the oil-refining art, and has been previously discussed above. Other equivalent reactions are known. The fuel fragments, unreacted water, and the small amount of air that acts as a carrier all pass through perforated plate 100, and upon contact with catalytic element 7*b*, the fuel and air then present combust, producing heat to be absorbed by the lower extension of iron bars 101, and conducted upwards to support the continuing catalyst hydrogenation reaction on serrated iron bars 99. Additional air and water are introduced via auxiliary air manifold 102, through air valves 105, which may be butterfly type valves or other suitable air valves, through a plurality of air channels 23*a*, 23*b*, 23*c*, 23*d* to various levels or zones of catalytic element 7*b*. Note that the beads of the element are held in place by retaining screen 103, adjacent to the air channels. The oxidative combustion of large molecules will necessarily proceed in stages, since each encounter with the catalytic surface will oxidize one, or only a few, bonds of the molecule. Injection of air and water at various levels in the column allows the catalytic combustion steam generation process to occur in "stages," according to the quantity, quality, and molecular activity (molecular weight) of the fuel molecules present at that particular stages.

As will be apparent to those skilled in the art, the configuration of the iron bars or other surfaces supporting the hydrogenation reaction may be varied considerably. Advanced heat transfer methods, such as heat pipes, may be used to conduct heat from catalytic element 7*b*, or another independent heat source, to the surface where hydrogenation is occurring.

Figure 5:
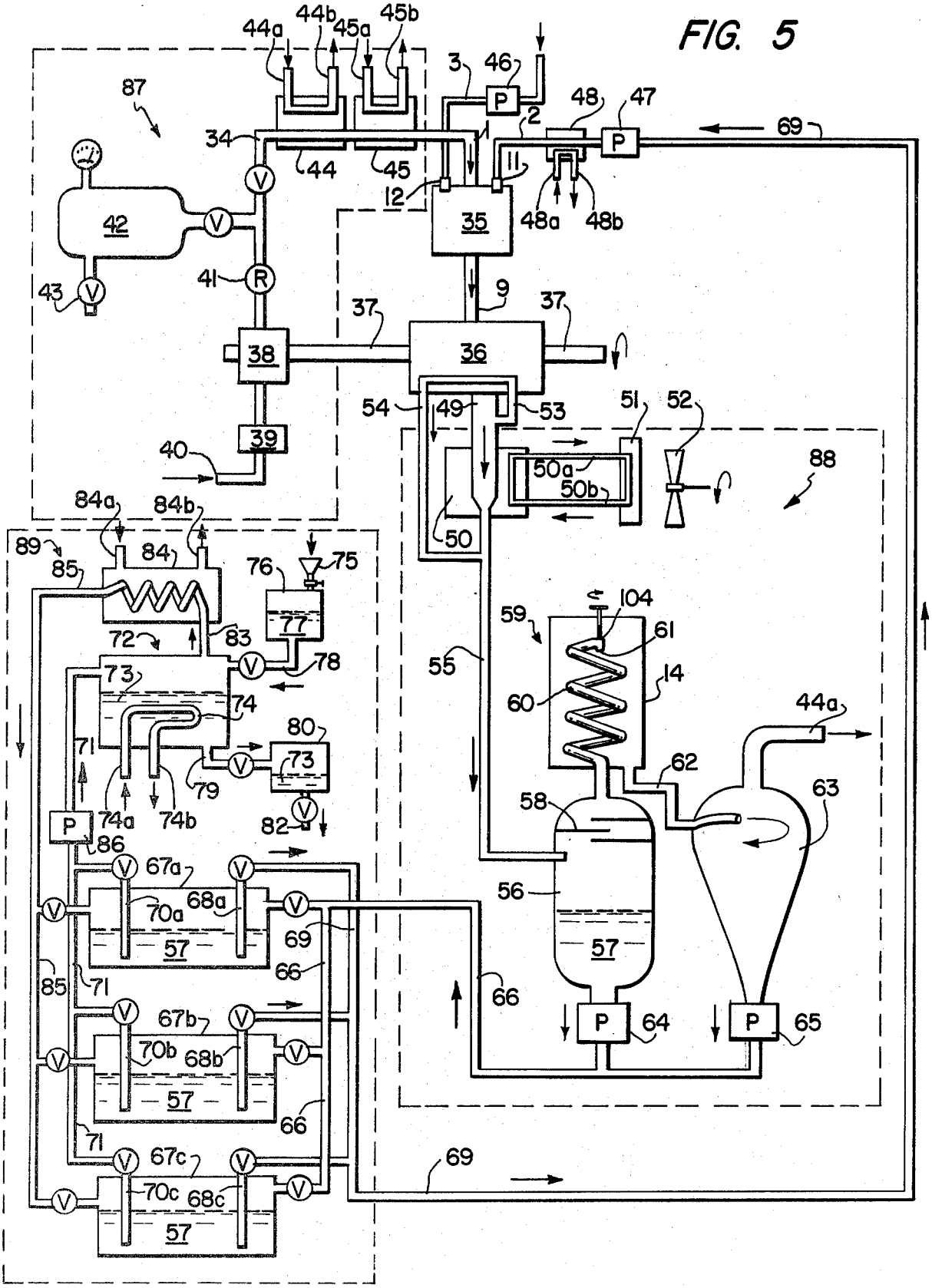
FIG. 5 is a block diagram showing a representative embodiment of apparatus for a closed system engine application.

FIG. 5 shows a block or schematic diagram of the preferred embodiment of the closed system application support apparatus, and includes three subsystems: an air supply subsystem designated 87, a water condensing and exhaust separation system designated 88, and a steam distillation water purification subsystem designated 89, in addition to the steam generator 35, and the steam driven motor 36.

To initiate combustion, compressed air is released from air flask 42, while fuel in fuel line 3 is pumped by fuel pump 46. Air heaters 44, 45 may be used to warm the air prior to introduction into the steam generator 35 via air inlet 1. Following fuel ignition, once the catalytic element within is heated, water may be pumped by water pump 47 through water warmer 48 through water line 2 through water injector 11 to generate steam that exits via steam outlet 9. This steam enters the steam driven motor 36, causing motor power shaft 37 to turn, thus powering air pump 38. Alternatively, a conventional auxiliary starting motor, not shown, may be used to turn the air pump shaft 37 and supply compressed air to initiate combustion. A supply of bottled oxygen could also be used for this purpose, in lieu of the air in air flask 42. In normal operation the valve to air flask 42 from air line 34 will remain closed, and air will be drawn through air intake 40, through air filter 39, through air pump 38, through air pressure regulator 41, and sent directly to steam generator 35 via air line 34. As those skilled in the art are aware, many means are available to supply compressed and heated air within the spirit and scope of this invention. The disclosed basic process requires only the pumping and heating of air to supply the steam generator 35. Air heater 44 is a catalytic afterburner that combusts any carbon monoxide that may be present in the exhaust gasses in exhaust line 44*a*, transfers the heat to air line 34, and emits CO-free exhaust gas through spent exhaust line 44*b*. Alternatively or simultaneously, a regular steam air heater 45 can heat the air with steam supplied via air heater steam lines 45*a*, 45*b*. Air may also be heated before it is compressed by air pump 38, step not shown. The larger temperature gradient before compression (i.e., cooler air) will allow for use of a smaller heat exchanger to transfer an equal amount of heat. But in turn, a larger and heavier air pump with a greater torque requirement will be required to pump the more voluminous warmer air.

When certain types of engines are decelerated under load, the energy loss of "engine braking" may be partially recoupled and harnessed by closing the valve before the air heaters 44, 45 in air line 34, and opening the valve to air flask 42 to allow the air pump to pressurize the flask. When steam driven motor 36 and coupled air pump 38 have slowed, the valve to air flask 42 is closed to retain the compressed air to reactivate the combustion process as previously described. Air pressure regulator 41 allows for delivery of variable quantities of compressed air in proportion to engine speed, to provide for acceleration and deceleration, and to optimize engine performance under variable load conditions.

Next, attention is directed to the water condensing and exhaust separation subsystem, generally designated 88. Waste steam leaving steam driven motor 36 via motor outlet 49, may at first be diverted wholly or partially for the various steam heating functions described herein, including heating the engine block or other casing of steam driven motor 36, via motor heating steam lines 53, 54 as shown. Thereafter, it enters first stage condenser 50, cooled by secondary coolant lines 50*a*, 50*b*, which transfer heat to an external radiator 51, cooled by fan 52. Normally it will be desirable to cool the steam, from e.g., 300° C., to just above 100° C. using a high temperature coolant. In most applications where there is a high velocity flow-through, the steam should not be allowed to form droplets, as these may severely pit the heat exhanger of first stage condenser 50. The cool steam, at about 100°-120° C., is conducted via steam line 55 to adiabatic expansion condenser 56, where it expands, cools below 100° C. and condense, as in a conventional refrigeration design where freon vapor is being recovered for reuse. Liquid water 57 is pumped out by water pump 64 for reuse, while the remaining vapor and exhaust gases pass through anti-splash fins 58, and into adiabatic reflux condenser 59, wherein water vapor is condensed in reflux condenser coil 60, which is cooled by chilled gases passing through exhaust gas venturi 61, and back down through condenser enclosure 14. Regulation valve 104 may be used to adjust the aperture of the venturi jet in order to regulate the pressures in adiabatic expansion chamber 56 and centrifugal separator 63. Exhaust gases and any remaining water or water vapor pass through vapor line 62 to reach centrifugal separator 63, wherein water droplets moving at high speed are collected in the bottom of the separator and pumped by water pump 65 to water storage tanks 67*a*, 67*b*, 67*c*, while exhaust gases and any unreclaimed water vapor pass into exhaust line 44*a*. As will be clear to those skilled in the art, there are numerous specific methods of condensing water vapor and removing exhaust gases within the general scope of the basic process disclosed. All the steps described need not be used. The embodiment shown is adequate to handle the throughput volume of an automobile cruising at 55 mph, which is about 3 gal. of liquid water per minute, or less. The disclosed basic process requires only the steps of condensation of the water and separation of the exhaust gasses.

As noted above in the "Statement of the Invention," the presence of $N_2$ in air leads to formation of $NO_x$ pollutants in high pressure combustion processes. Also, sulfur is often present in fuel stocks, producing $SO_x$ pollutants upon combustion. These substances are soluble in water to produce various acids, such as nitric, sulfuric, nitrous, sulfurous, etc., which may pass through the steam generator in low concentrations in the recycled water drawn through water recirculation line 69 to steam generator 35. However, when acid buildup reaches a point where it can damage the apparatus, a process must be implemented to purify the water without releasing the $NO_x$, $SO_x$, or the acids into the environment.

The steam distillation water purification subsystem 89 represents a detailed embodiment of a process for purifying water. Condensed water with acid impurities is pumped to one of three water storage tanks 67*a*, 67*b*, 67*c*, via condenser outlet line 66. Valves in this water line direct the water to the tank in current use. The valves for the water recirculation uptake lines 68*a*, 68*b*, 68*c*, are initially set to withdraw water from that same tank. Since titration and distillation of dilute acid is an inefficient use of the energy required to boil the water, the system is operated continuously until the tank in current use reaches a pre-set maximum concentration. Then the valves are reset to allow the steam generation process to continue with a fresh tank of distilled water. Meanwhile, still water pump 86 draws impure water containing acids through still uptake lines 70*a*, 70*b*, 70*c*, and still feed line 71. The system as shown is capable of titrating the acids in the water and distilling water from the resulting salt brine into an empty third tank, for use in continued steam generation. Water enters steam distillation unit 72, and is titrated by a basic titrant solution 77, such as concentrated $MH_4OH$ aqueous, from titrant supply tank 76. Tank 76 is filled via filler funnel 75, and is emptied through titrant line 78. The pH of brine solution 73 is kept at or near a value of seven (neutral) by the addition of titrant in proportion to incoming acid in the water. Steam heating element 74 boils brine solution 73, and is heated by heating element steam lines 74*a*, 74*b*. The resulting steam exits via still outlet line 83 to a water jacket condenser 84, cooled by water coolant lines 84*a*, 84*b*. Condensed distilled water travels via condenser outlet line 85 back to the empty water storage tank. When a tank of water has been completely purified in this manner, the valves may be reset to allow use of this clean tank, while the tank which has meanwhile accumulated acids through continued system operation is then titrated and distilled into the now empty third tank. At the end of one or several cycles, concentrated brine solution 73 may be drained through brine drain line 79 into concentrated brine holding tank 80, and periodically released through brine drain port 82 for proper disposal or reclaimation. Care may be required to prevent entry of brine salts into the process feedwater, as this can foul catalytic element 7*b* with salt scale. As those skilled in the art will understand, many other specific means could be employed to purify acid-containing water, including an ion-exchange resin column, or a straight piped still with no holding tanks, or with only one holding tank. The disclosed primary process requires only a step in which water is purified.

One alternative purification method, not shown, would be through the use of high-pressure osmotic desalinization. In such a system, salt brine resulting from titration of acids is pumped into a tank under pressure, e.g., 10–6,000 psi. Such pressure causes the water to flow out through a suitably chosen osmotic membrane which forms one side of the tank, while the salt molecules/ions remain in the tank. Eventually, the supersaturation of the brine solution causes the salts to crystallize out in the tank, whereupon the crystals may be removed mechanically, while additional dilute brine is continuously fed in. Water crossing the membrane is pure, and may be returned for reuse in the steam generation process. Ionic separation may be improved by application of an electric potential across the membrane to keep small positive ions from crossing the membrane. High-pressure osmotic desalinization is a well-developed art.

As will be understood by those skilled in the art, the described process, apparatus, and the principles of the applicants' system, have relevance to a wide range of mechanical and industrial power uses, of which vehicular propulsion is only one example. Our invention is not limited to what is described in the specification and drawings.

What is claimed is:

1. A process for vaporizing water via catalytic combustion comprising steps (a) for reacting a mixture of fuel, oxidizer and water on a catalytic surface, where the catalytic oxidation of the fuel releases thermal energy which vaporizes the water, and where the water and water vapor pass directly across the working surface of the catalyst, (b) for conducting the water vapor and combustion product gases away from the catalytic element, and (c) for utilizing the product.

2. A process for vaporizing water as in claim 1, in which the oxidizer used is air.

3. Apparatus for vaporizing water comprising (a) a catalytic element, (b) means for supplying a mixture of fuel, oxidizer and water to said element to support a combustion-vaporization reaction thereon, and (c) means for utilizing the mixture of water vapor and combustion product gases so produced.

4. Apparatus for vaporizing water as in claim 3 wherein the said means for supplying oxidizer to the catalytic element are adapted to the use of air as an oxidizer.

5. A process for vaporizing water as in claim 1, wherein the mixture of fuel, oxidizer and water is directed to the catalytic element in a combustion chamber.

6. An apparatus for vaporizing water as in claim 3, wherein the apparatus comprises a combustion chamber enclosing therein said catalytic element, and means for supporting said catalytic element within said chamber, with said means for supplying a mixture of fuel, oxidizer and water to the chamber in fluid communication with said chamber, wherein said mixture sustains a combustion-vaporization reaction on the element, and with means for receiving and utilizing the water vapor produced being in fluid communication with said chamber.

7. A process for vaporizing water as in claim 5, comprising, in addition, steps for pressurizing the oxidizer, fuel, and water to be directed into the combustion chamber, for injecting the pressurized oxidizer, fuel, and water into the combustion chamber, whereupon the fuel, oxidizer, and water react to produce pressurized water vapor, and for utilizing the pressurized water vapor so produced.

8. An apparatus for vaporizing water as in claim 6, wherein the apparatus also comprises means for pressurizing fuel, oxidizer and water, means for injecting said fuel, oxidizer and water under pressure into said combustion chamber containing a catalytic element upon which the fuel and oxidizer combust producing heat which vaporizes the water, and means for utilizing the pressurized water vapor so produced.

9. A process for vaporizing water as in claims 1, 5, or 7, comprising additional steps for warming the oxidizer, fuel, and water prior to their being directed to the catalytic element.

10. An apparatus for vaporizing water as in claims 3, 6, or 8, comprising additional means for warming the oxidizer, fuel, and water prior to their being directed to the catalytic element.

11. A process for vaporizing water as in claims 1, 5, or 7, comprising additional steps for generating ultrasonic energy and for transmitting the ultrasonic energy into the oxidizer, fuel, and/or water prior to their being directed to the catalytic element, where the ultrasonic energy aids in promoting the mixing of said oxidizer, fuel or water prior to combustion.

12. An apparatus for vaporizing water as in claims 3, 6, or 8, comprising additional means for generating ultrasonic energy and means for transmitting the ultrasonic energy into the oxidizer, fuel, and/or water prior to their being directed to the catalytic element, where the ultrasonic energy aids in promoting the mixing of said oxidizer, fuel or water prior to combustion.

13. A process for vaporizing water as in claims 1, 5, or 7, comprising an additional step for catalytic hydrogenation of unsaturated fuels prior to combustion on the catalytic element.

14. An apparatus for vaporizing water as in claims 3, 6, or 8, comprising additionally a hydrogenation catalyst suitable for the hydrogenating of unsaturated hydrocarbon fuel substances, means for supporting said hydrogenation catalyst, means for conducting the unsaturated hydrocarbon fuel substances to said hydrogenation catalyst, means for delivering water to said hydrogenation catalyst, whereupon the unsaturated hydrocarbon fuel is hydrogenated and is broken into smaller, more saturated fuel molecules, means for supplying heat to said hydrogenation catalyst to support the hydrogenation reaction thereon, means for conducting the product to the catalytic element for utilization in catalytic combustion steam generation, means for supplying oxidizer to said catalytic element to support combustion thereon, means for directing water to said catalytic element, which is vaporized thereon, and means for utilizing the water vapor so produced.

15. A process for vaporizing water as in claim 1, comprising in addition steps for heating the catalytic element to assist the initiation of combustion upon said element.

16. An apparatus for vaporizing water as in claim 3, comprising additional means for heating the catalytic element to assist the initiation of combustion upon said element.

17. A process for vaporizing water as in claim 1, comprising additional steps for supplying a second fuel of heavier grade, for directing the second fuel to the catalytic element, for substituting the second fuel for the first fuel during the continuance of the catalytic combustion process after the catalytic combustion reaction has reached a temperature that will support efficient combustion of the second fuel, whereupon steam generation may proceed utilizing the second fuel.

18. An apparatus for vaporizing water as in claim 3, comprising additional means for supplying a second fuel of heavier grade, and means for directing said second fuel to the catalytic element.

19. A process for vaporizing water as in claim 1, comprising additional steps for supplying a fuel-water composition, in the form of a solution or emulsion, for mixing the fuel-water composition with oxidizer, for directing the mixture of oxidizer, fuel, and water to the catalytic element whereupon the fuel is combusted and the water is vaporized by the resulting heat, and for utilizing the steam so produced.

20. An apparatus for vaporizing water as in claim 3, comprising additional means for supplying a fuel-water composition, and means for directing the composition to the catalytic element.

21. A process for vaporizing water in a catalytic combustion steam generator as in claims 5 or 7, comprising additional steps for compressing oxidizer, for regulating the pressure thereof, for introducing the oxidizer into the combustion chamber, whereupon pressurized steam is produced, for delivering a portion of the steam to a steam driven motor which generates mechanical energy, and for transmitting and utilizing a portion of the mechanical energy to carry out the said steps for compressing oxidizer.

22. An apparatus for vaporizing water in a catalytic combustion steam generator as in claims 6 or 8, comprising additional means for compressing oxidizer, means for regulating the pressure thereof, means for transmitting the oxidizer to the combustion chamber, whereupon pressurized steam is produced, means for transmitting a portion of the steam to a steam driven motor which generates mechanical energy, and means for transmitting a portion of the mechanical energy to operate said means for compressing oxidizer.

23. A process for vaporizing water as in claims 5 or 7, comprising additional steps for utilizing steam in a closed system steam utilization application, for condensing waste steam recovered from said closed system application, for separating and removing exhaust gases and unreacted air components, for recovering and storing the water produced by said condensation and separation steps, and for recirculating said water for reuse in the catalytic combustion steam generator.

24. A process for vaporizing water as in claim 25, comprising an additional step of purifying the recovered water to remove acids in the water resulting from dissolved exhaust gases.

25. An apparatus for vaporizing water as in claims 6 or 8, comprising additional means for utilizing steam in a closed system steam utilization application, means for condensing waste steam recovered from said closed system application, means for separating exhaust gases and unreacted air components, means for recovering and storing the water produced by said means for waste steam condensation and exhaust gas separation, and means for recirculating the water for reuse in the catalytic combustion steam generator.

26. An apparatus for vaporizing water as in claim 25, comprising additional means for purifying the recovered water to remove acids in the water resulting from dissolved exhaust gases.

27. A process for vaporizing water as in claim 5, comprising additional steps for directing a supply of oxidizer to the catalytic element at a plurality of successive points adjacent to the main flow of other reactants across and through the catalytic element, and for regulating the quantity of oxidizer so directed to the catalytic element, in order to create zones of progressively more complete combustion.

28. A process for vaporizing water as in claim 5, comprising additional steps for directing a supply of fuel to the catalytic element at a plurality of successive points adjacent to the main flow of other reactants across and through the catalytic element, and for regulating the quantity of fuel so directed to the catalytic element.

29. A process for vaporizing water as in claim 5, comprising additional steps for directing a flow of water to the catalytic element at a plurality of successive points adjacent to the main flow of other reactants across and through the catalytic element, and steps for regulating the quantity of water so directed to the catalytic element.

30. An apparatus for vaporizing water as in claim 6, comprising additional means for directing a supply of oxidizer to the catalytic element at a plurality of successive points adjacent to the main flow of the reactants across and through said catalytic element, and means for regulating the quantity of oxidizer so directed to said catalytic element, in order to create zones of progressively more complete combustion.

31. An apparatus for vaporizing water as in claim 6, comprising additional means for directing a supply of fuel to the catalytic element at a plurality of successive points adjacent to the main flow of other reactants across and through said catalytic element, and means for regulating the quantity of fuel so directed to said catalytic element.

32. An apparatus for vaporizing water as in claim 6, comprising additional means for directing a supply of water to the catalytic element at a plurality of successive points adjacent to the main flow of other reactants across and through said catalytic element, and means for regulating the quantity of water so directed to said catalytic element.

33. A process for vaporizing water in a combustion chamber as in claim 5, comprising additional steps to regulate the flow of oxidizer, fuel, and water being injected into the combustion chamber so as to induce a succession of explosive expansion steam generation states followed alternately by partial vacuum states induced by the rapid exiting of the steam, whereupon the partial vacuum induces a flow of oxidizer into the combustion chamber through a one-way oxidizer valve, and for utilizing the pulsed steam so produced.

34. An apparatus for vaporizing water as in claim 6, comprising additionally a one-way oxidizer valve placed at the oxidizer inlet to the combustion chamber, and means for regulating the flow of fuel and water so as to induce a succession of explosive expansion steam generation states followed alternately by partial vacuum states induced by the rapid exiting of the steam, whereupon the partial vacuum induces a flow of oxidizer into the combustion chamber through said one-way oxidizer valve, and means for utilizing the pulsed steam so produced.

35. A process for vaporizing water as in claim 19, comprising an additional step for suspending the fuel in the water by emulsifying or dissolving it to form a fuel-water composition.

36. An apparatus for vaporizing water as in claim 20, comprising additionally means for suspending the fuel in the water by emulsifying or dissolving it to form a fuel water composition.

* * * * *